US006296156B1

(12) United States Patent
Lasserre et al.

(10) Patent No.: US 6,296,156 B1
(45) Date of Patent: Oct. 2, 2001

(54) DEVICE FOR MOUNTING A VALVE ON A CONTAINER, AND DISPENSER CONTAINING A PRODUCT UNDER PRESSURE FITTED WITH SUCH A DEVICE

(75) Inventors: Pierre-Andre Lasserre, Coubron; Marcel Sanchez, Aulnay-sous-Bois, both of (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 09/568,812

(22) Filed: May 11, 2000

(30) Foreign Application Priority Data

May 11, 1999 (FR) ..... 9905998

(51) Int. Cl.[7] ..... B65D 83/14
(52) U.S. Cl. ..... 222/402.1; 222/394; 277/634
(58) Field of Search ..... 222/402.2, 402.18, 222/402.1, 394, 630, 636, 634

(56) References Cited

U.S. PATENT DOCUMENTS 3,138,304 * 6/1964 Raehs ..... 222/394
4,549,830 * 10/1985 Mette ..... 277/636
5,083,684 * 1/1992 Ebina et al. ..... 222/402.1
5,586,695 * 12/1996 Labus et al. ..... 222/402.1

FOREIGN PATENT DOCUMENTS 11 50 399 B 6/1963 (DE) .
88 00 584 U 4/1988 (DE) .
0 850 851 A 7/1998 (EP) .
2 508 136 A 12/1982 (FR) .
WO 86 06701A 11/1986 (WO) .

* cited by examiner

*Primary Examiner*—Kevin Shaver
*Assistant Examiner*—Patrick Buechner
(74) *Attorney, Agent, or Firm*—Oblon, Spivak, McClelland, Maier & Neustadt, P.C.

(57) ABSTRACT

A mounting device for mounting a valve on a container and a dispenser containing a product under pressure fitted with such a mounting device are both provided. The mounting device includes: a first fastening device configured to fasten the mounting device to an open edge of the container; a second fastening device configured to fasten the dispensing valve on the mounting device; a first groove formed between the first and second fastening devices; and a locking device intended to be positioned in the first groove so as to allow the first fastening device to be clamped onto the open edge, wherein the action of clamping is a result of radial enlargement of a bottom of the first groove.

21 Claims, 4 Drawing Sheets

DEVICE FOR MOUNTING A VALVE ON A CONTAINER, AND DISPENSER CONTAINING A PRODUCT UNDER PRESSURE FITTED WITH SUCH A DEVICE

BACKGROUND OF THE INVENTION

FIELD OF THE INVENTION

The present invention relates to a device for mounting a dispensing valve on a container containing a product that is to be dispensed, with the aid of a pressurized gas, and to a dispenser equipped with such a device. More specifically, the present invention is aimed at improving dispensers commonly known as "aerosol dispensers".

Dispensers of the "aerosol" type are currently used for packaging and dispensing products in various fields, such as the field of cosmetics, dermopharmaceuticals, household or food, in the field of paint, health and hygiene, in the field of technical products, adhesives, insecticides, plant-treatment products, etc. In general, these products are dispensed in the form of a jet of liquid, gel, spray or foam/mousse.

Conventionally, an "aerosol" dispenser of this kind is made up of a container containing the product that is to be dispensed, of a dispensing valve collaborating with the dispensing head, such as a push-button equipped with an outlet orifice. A mounting device is provided for mounting the dispensing valve in a leaktight manner on the container. Actuation of the dispensing head makes it possible to set up a communication between the inside of the container and the dispensing orifice through actuation of the valve. Under the effect of a pressure inside the container, as a result, for example, of the action of a propellant gas, packaged in the container, actuation of the dispensing valve by the user causes a dose of product to be ejected.

Customarily, particularly in the case of "aerosol" dispensers, the dispensing valve is mounted on the container by means of a valve holder cup, generally made of metal. A cup such as this is obtained in a conventional way by stamping then drawing a roundel, made, for example, of tin plate.

A valve holder cup such as this must, in general, fill two functions: on the one hand, it must hold the dispensing valve in a leaktight manner inside the cup while allowing an actuation and dispensing means, such as an emerging valve stem, to pass to the outside, and on the other hand, it must be capable of being mounted in a leaktight manner on the open edge of the product container. In certain cases, the valve holder cup must also hold together various constituent parts of the valve which are located inside the valve body.

In the known way, the valve holder cup is mounted on the container and the valve is mounted in the cup by crimping or expansion rolling a portion of the cup onto the valve body and onto the open edge of the container, respectively.

The robustness of the mounting of the valve of the container is of prime importance because the internal pressure there may be inside an aerosol dispenser may be as high as 12 bar or even 15 bar. Metal valve holder cups mounted by crimping or expansion rolling are suitable for withstanding these pressures. However, there is a risk that this type of valve holder cup may be damaged by the product that is to be dispensed, particularly when this product contains corrosive components, unless that surface of the cup which comes in contact with the product is coated with a lacquer or some other inert thermoplastic layer.

However, mounting a valve holder cup provided with such a protective layer has the drawback that, during the crimping or expansion rolling of the cup, the protective lacquer or the anti-corrosion layer may become damaged.

Document FR-A-2 508 136 discloses an aerosol dispenser, in which the dispensing valve is mounted using a plastic device. However, this mounting device is designed to hold together the various components of the valve itself and at the same time mount this device on a product container. Furthermore, this mounting device is made up of various components which are complicated to mould and the assembly of which involves a number of stages. What is more, this device is ill-suited to the mounting of a conventional valve, available on the market at an economically viable price. Furthermore, the mounting device itself, according to FR-A-2 508 136, is relatively expensive. Finally, this device is unable to compensate for the manufacturing tolerances there are between the valve body and the open end of the product container.

Document DE-B-11 50 399 describes a plastic mounting device of the aforementioned kind. This device comprises a ring which, once a valve holder cup has been mounted on the product container, provides the cup with shape stability. The cup has a "U"-like structure in which the ring is inserted. The "U" is formed by a bottom and two lateral walls, of identical thickness. The thickness of these walls is relatively important. The cup is clipped on the container by means of an annular bulge situated on an external lateral wall of the "U". The mounting of the ring in the groove causes a radial extension of the external sidewalls of the groove. This mounting system has the drawback that it requires close dimensional tolerances on the cup, on the valve body and on the opening of the container, and the risk of leakage cannot be excluded. Furthermore, like in the prior-art device described hereinabove, this mounting system is ill-suited to the attaching of a conventional valve available commercially.

SUMMARY OF THE INVENTION

So, one of the objects of the present invention consists in providing a leaktight and reliable mounting of a valve on any kind of container, using means which are simple and easy to implement, and to do so in particular for containers with wide manufacturing tolerances. This is the case, in particular, with containers made of glass, blow-moulded plastic and certain metal containers, for example those made of aluminium or tin plate, which have a non-machined open end.

Another object of the present invention is to provide a device for mounting a dispensing valve, particularly a conventional valve, on a product container, which is easy to produce and which has the lowest possible cost price.

Furthermore, according to yet another object of the invention, the mounting device is to be suitable for dispensing valves of different sizes and types, for example valves, the body of which consists of an elastomeric material, as described in Patent Application EP-A-0 850 851 in the name of the applicant company.

So, a first aspect of the present invention relates to a device for mounting a dispensing valve on a container of product under pressure, comprising:

a) first mounting means for fastening the device to an open edge of the container;

b) second mounting means for fastening the said dispensing valve on the said mounting device;

c) a first groove formed between the first and second mounting means; and d) locking means intended to be positioned in the said groove so as to allow the said first mounting means to be clamped onto the said open edge, said clamping being a result of radial enlargement of a bottom of said first groove.

In general, the radial deformation is made permanent.

This arrangement allows the valve simultaneously to be locked in the mounting device and the mounting device itself to be held on the open end of the container.

In addition, a second aspect of the present invention provides an aerosol dispenser equipped with a mounting device according to the first aspect, for dispensing a product using a propellent gas.

Advantageously, the first and second mounting means and the first groove form a valve holder cup made entirely of plastic, particularly as a single piece. Alternatively, they may be made of metal, provided that a certain amount of deformation of the groove is achievable without the need to resort to conventional expansion rolling or crimping methods.

To this end, the first groove may comprise a portion, for example a bottom, with a deformable wall, particularly of lesser thickness, so that it can be deformed, particularly radially. Advantageously, the valve holder cup is shaped so that the force needed for deformation is relatively low, by comparison with the deformation force needed to perform expansion rolling or crimping. Advantageously, the deformable wall is annular, continuous or discontinuous.

According to an advantageous aspect of the invention, the deformation of the said deformable wall is performed by locking means which have a shape, particularly an annular shape, at least one portion of which is of a thickness to, in the mounted position, collaborate with a corresponding portion of the first and/or second mounting means. Thus, by causing an enlargement of at least part of the said groove, the first external mounting means are locked in leaktight manner against the open edge of the container.

Advantageously, the locking means may further comprise an annular element capable of improving the clamping of the first mounting means on the open edge of the container. Hence, the first external mounting means may form a second open groove, opposite the first, forming a U-shaped portion for gripping the open edge of the container.

According to one embodiment of the invention, the first mounting means are positioned between the said open edge of the container and the said annular element of the locking means.

As a preference, means are provided for locking the locking means in the said first groove. An arrangement such as this may be provided, for example, by a bulge/groove system that can be snap-fastened together.

According to a preferred embodiment, the said groove comprises deformable connecting means capable of allowing the said groove to be enlarged as the locking means are introduced into it, so as to clamp the said first mounting means onto the open edge of the container.

Thus, the second internal mounting means are permanently pressed against a lateral wall of the valve body. At the same time, the external first mounting means engage in leaktight manner against an open end edge of the container.

Advantageously, the second mounting means may further comprise an internal profile capable of collaborating with a complementary profile formed on the side wall of the valve body.

The locking means may be equipped with at least one profile such as a chamfer which encourages them to enter the said groove. These locking means may be made of metal or plastic.

According to one particular embodiment, the mounting device may be screwmounted onto the open edge of the container. In this case, the container has a threaded neck, which is advantageous in particular when the container is made of glass.

Advantageously also, the first and second mounting means are made of a plastic chosen, for example, from high or low density polyethylenes, polypropylenes, ethylene vinyl acetate copolymers, polyamides, polycarbonates, polyester terephthalates, polyvinyl chlorides or polyacetals.

Hence, the first and second mounting means and the locking means may be made of one and the same plastic or two different plastics.

The dispenser at which the present invention is aimed comprises a container containing a product, particularly a liquid, placed under pressure by a conventional propellant, to be dispensed by actuation of the dispensing valve. The dispensing valve is mounted on an open end of the container by means of a mounting device as described hereinabove. The valve is equipped, in a way known per se, with actuating and dispensing means, such as a push-button equipped with a dispensing nozzle.

According to one embodiment, the open end of the container is formed by a neck, the said neck having a profile capable of engaging with a portion formed on the said external first mounting means.

According to one embodiment, the neck of the container may be rolled outwards with respect to the central axis of the container or alternatively may be rolled inwards with respect to the axis of the container.

According to one particular embodiment, the neck of the container has an edge bent towards the central axis of the container and capable of collaborating with a portion of a valve comprising a body made of an elastomeric material.

To allow a better understanding of the present invention, a number of embodiments of the invention depicted in the appended drawings will now be described by way of purely illustrative and non-limiting examples.

DETAILED DESCRIPTION OF THE PREFERRED EMBODIMENTS

Figure 1:
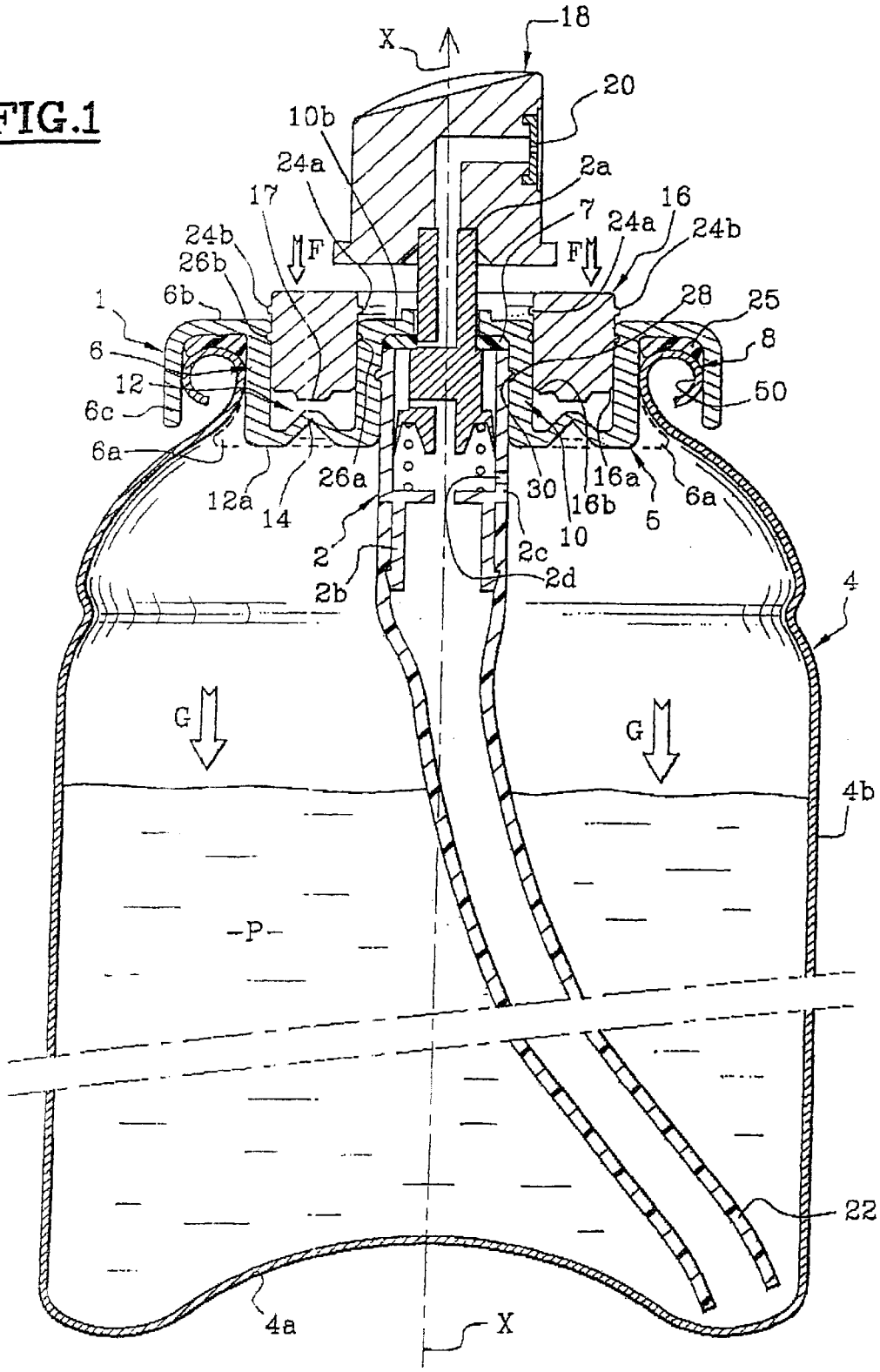
FIG. 1 depicts a view in axial section of a dispenser, comprising a product container fitted with a device for mounting a dispensing valve according to a first embodiment of the invention.
Figure 2:
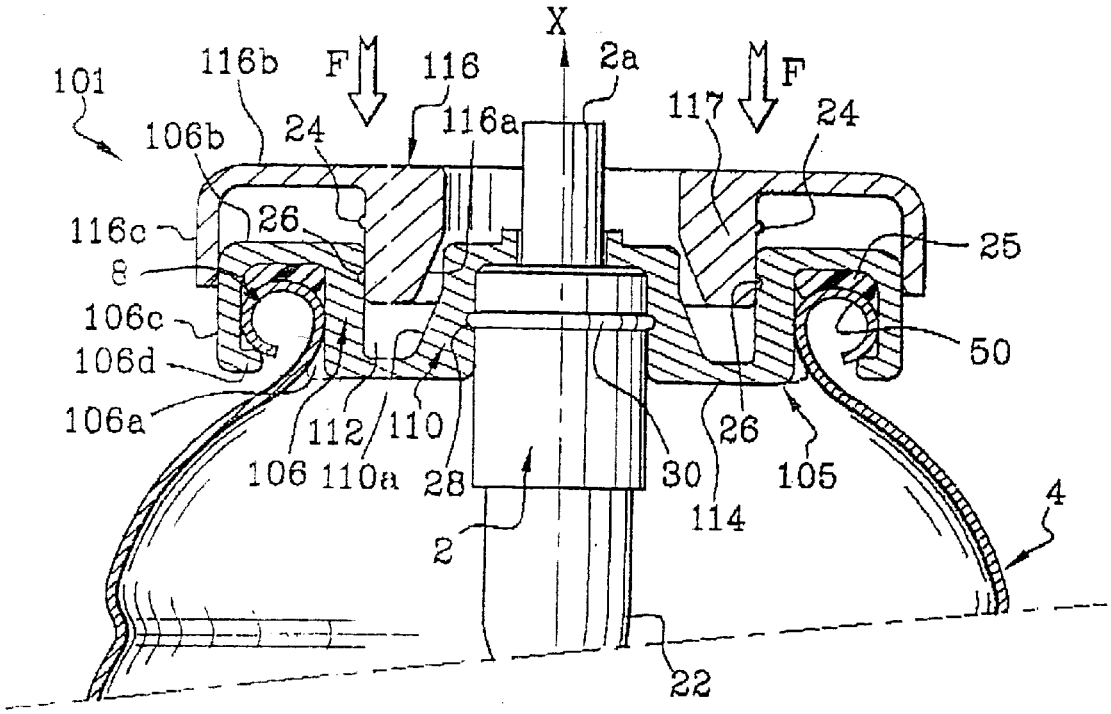
FIGS. 2 to 6 depict a partial axial section view illustrating other embodiments of mounting devices according to the invention.

FIGS. 1 and 2 show a device 1 for mounting a dispensing valve 2 according to a first embodiment of the invention.

The assembly 1 comprises a container 4 intended to contain a product P to be dispensed, particularly a liquid. It also contains an appropriate amount of propellent gas G. The container 4 has a rolled neck 50 constituting an open end 8. The container 4, of cylindrical overall shape, has a side wall 4*b* which is of revolution about an axis X, and a closed end 4*a*. In the example in question, the container 4 is a one-piece aluminium can. It may alternatively be made of tin plate, glass or any other appropriate thermoplastic.

The open end 8 of the container 4 is closed by a cup 5. The cup 5 is made of plastic, such as polyacetal, for example polyoxymethylene (POM). The cup 5 bears external first mounting means 6 and internal second mounting means 10.

Thus, the cup 5 has a peripheral portion 6, 6*b*, 6*c* which can be mounted on the neck of the container, an annular groove 12, at least one part of which is radially deformable, and a central portion 10, 10*b* of cylindrical shape capable of housing and holding a dispensing valve 2.

The peripheral portion is made up of a cylindrical skirt 6*c* which bears against the outer part of the neck 50, an annular plate 6*b* positioned over the neck, the internal cylindrical portion 6 being intended to be pressed against an internal portion of the neck 50, under the action of locking means 16, as will be explained later on.

By virtue of this configuration, the peripheral portion 6, 6*b*, 6*c* has an axial cross section in the shape of an inverted U arranged around the rolled neck 50. An elastomeric seal 25 placed between the cup 5 and the plate 6*b* provides sealing between the container 4 and the cup 5. The U-shaped portion 6, 6*b*, 6*c* constitutes the said external first mounting means previously described.

The groove 12 is defined by the said cylindrical portion 6, a bottom 12*a* and an external surface of the aforementioned second mounting means 10, of approximately cylindrical shape.

The internal mounting means 10 also define a housing which takes the body 2*c* of the dispensing valve 2, and hold the said valve in place.

The valve body 2*c* has an outer annular bulge 30 which collaborates with a complementary groove 28 made on the interior face of the internal second mounting means 10. The dispensing valve 2 is thus fixed into the cup 5 in leaktight manner.

Furthermore, it can be seen that the valve used is a valve with an additional gas intake, the propellent gas G being let into the valve body through an orifice 2*d* and mixed with the product P that is to be dispensed.

The internal second mounting means 10 at their upper end form a transverse wall 10*b* which has an axial opening 10*c*. An emerging valve stem 2*a* connected to a push-button 18 passes through this opening. Depressing the push-button 18 causes the valve to open and product P, packaged in the container 4, to be conveyed via the valve stem 2*a* towards the dispensing orifice 20. This orifice 20 is formed in the pushbutton. An annular seal 7 made of elastomer seals between the valve body 2*c* and transverse wall 10*b* of the cup 5.

Furthermore, the valve body 2*c* comprises a feed duct 2*b* connected to a dip tube 22 extending as far as the bottom 4*a* of the container. Aside from the product P, the container 4 contains a propellent gas G exerting permanent pressure on the product P. The propellent gas G is, as is known, a compressible or liquefiable gas.

One of the essential parts of this embodiment of the invention consists of a locking ring 16 which is intended to clamp the external mounting means 6, 6*b*, 6*c* onto the neck 8 of the container 4.

To this end, the groove bottom 12*a* has a region of lesser thickness 14 shaped to form deformable connecting means. These connecting means form a "toggle joint" capable, when stressed, of radially enlarging at least part of the groove 12. Thus, when the locking ring 16 is introduced into the groove 12, the bottom of the groove 12 becomes enlarged to occupy a position like the position depicted in dotted line by the reference 6*a*.

The operation of introducing the locking ring is made easier by the presence of two chamfers 16*a* and 16*b* formed on the lower end of the locking ring 16. An annular bulge 17 capable, at the end of depression of the locking ring 16, of coming to bear against the "toggle joint" 14 and of deforming it in the way described hereinabove is formed on this end. Thus, the region 14 flattens appreciably and occupies a shape as drawn in dotted line in FIG. 1.

As a result, the bottom 12*a* of the groove becomes radially enlarged, mainly outwards. The formation of a radially projecting portion 6*a* is thus brought about, so that this engages with the container 4 under the rolled neck 50. In the example in question, the first mounting means 6, 6*b*, 6*c* at the same time position themselves in a position for clamping against the neck 50 and the internal second mounting means 10 become pressed against the valve body 2*c*, so as both to hold the valve on the container and to mount the valve body 2*c* in leaktight fashion in the centre of the cup 5.

A clip-fastening system may be provided in order to ensure that the ring 16 is held reliably in the groove 12. To this end, and as visible in the drawing, bulges 24*a* and 24*b* are formed respectively on the internal and external faces of the ring 16, to collaborate with the grooves 26*a* and 26*b* formed in the walls of the first and second mounting means 6 and 10 respectively.

The reverse system may also be provided, whereby the internal face of the internal second mounting means 10 has a bulge capable of collaborating with a corresponding groove in the valve body. As an alternative, such a bulge may be shaped by forming to form a groove in the body of a conventional pump. An arrangement such as this is described, for example, in French Patent No. 98/03831 in the name of the applicant company.

Through the arrangement described hereinabove, the valve can be mounted in leaktight and non-removable manner on the container 4.

A plastic mounting device such as this also has the following advantages:

- it has no portion likely to be exposed to any corrosion by the product;
- it is capable of compensating for the considerable tolerances on the neck of the container and on the valve body;
- it is simple to produce;
- it can be mounted in a simple mounting operation;
- it can be made at an attractive manufacturing cost.

FIGS. 2 to 7 illustrate other embodiments according to the invention.

In these figures, the parts which are identical to the corresponding parts in FIG. 1 bear the same reference numerals. The parts which are similar or fulfill a similar role bear the reference numerals of FIG. 1, increased by a multiple of 100.

A detailed description of the parts already described with reference to the preceding figures will not be given again during the description of FIGS. 2 to 7.

FIG. 2 depicts a mounting device 101 consisting of a valve holder cup 105 and of a fixing ring 116. The valve holder cup 105 comprises first 106,106*b*, 106*c* and second 110 mounting means and a groove 112 located between the said first and second mounting means. The bottom 114 of the groove 112 is deformable and allows an annular portion 117 of the fixing ring 116 to be forcibly introduced. The annular portion 117 has an internal chamfer 116*a* capable, in the mounted position, of collaborating with an inclined circular portion 110*a* of the internal mounting means 110. The valve holder cup 105 comprises an annular plate 106*b* which contacts an elastomeric seal 25 resting on the rolled edge 50 of the container 4. The annular plate 106*b* is connected to a cylindrical skirt 106*c* which presses laterally against the external portion of the rolled neck 50. There is a rim 106*d*, designed to fit externally, by snap-fastening, under the rolled neck 50.

The fixing ring 116 has an annular plate 116*b* capable of bearing against the annular plate 106*b* of the cup 105. This annular plate 116*b* is secured to a peripheral skirt 116*b*, capable of clamping the skirt 106*c* radially against the rolled neck 50. A bulge 24/groove 26 system is provided to hold the fixing ring 116 in the groove 112. Similarly, a bulge 30/groove 28 system holds the valve body 2*c* in the cup 105.

When mounting the device 101, the valve body 2*c* is first of all introduced into the cup 105. The seal 25 is placed in the bottom of the peripheral groove defined by the elements 106, 106*b*, 106*c*. In the next step, the cup 105 is snap-fastened onto the neck 50 of the container by pushing it axially. By pressing in the direction of the arrows F, the fixing ring 116 is mounted, non-removably, in the groove 112. During this operation, the cross-shaped structure of the portion 117 causes the bottom 114 of the groove 112 to enlarge (see bulge 106*a*) enough to clamp the external mounting means 106, 106*b*, 106*c* in leaktight manner on the rolled edge 50. At the same time, the internal mounting means 110 press in leaktight manner against the valve body 2*c*. Furthermore, the mounting device 101 can be mounted so that it is very firmly held on the container, on account of the presence of the external cylindrical skirt 116*c*. This is because this skirt 116*c* stiffens the skirt 106*c* of the cup 105 and also holds the rim 106*d* in position under the cup 105.

Figure 3:
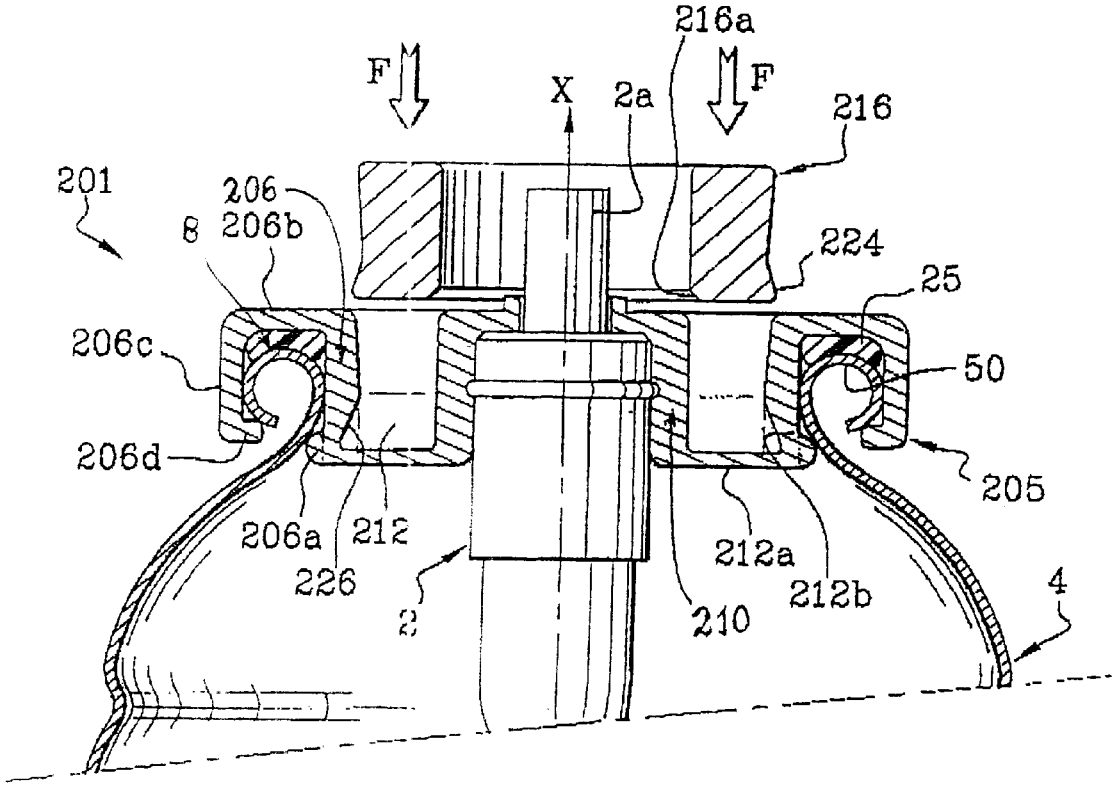

FIG. 3 shows one embodiment of the invention similar to the one described with reference to FIG. 2, except that the fixing ring 216 of the device 201 has no external clamping skirt. The fixing ring 216 is of a somewhat different shape from the one shown in FIG. 2. Specifically, it is in the form of a substantially cylindrical annulus. There is a chamfer 216*a* to ease its insertion into the groove 212. The groove has a bulge 226, the outside diameter of which is greater than that of the rest of the groove. An annular bulge 224 is provided on the fixing ring, and is intended to be housed in the said portion 226. It should be noted that the bottom 212*a* and a lateral peripheral region 212*b* are designed to deform as the cup 205 is introduced into the neck 50.

Once the cup 205 has been fitted in the neck 50, the introduction of the fixing ring 216 into the groove 212 radially forces a bulge 206*a* of the cup 205 under the neck 50.

Figure 4:
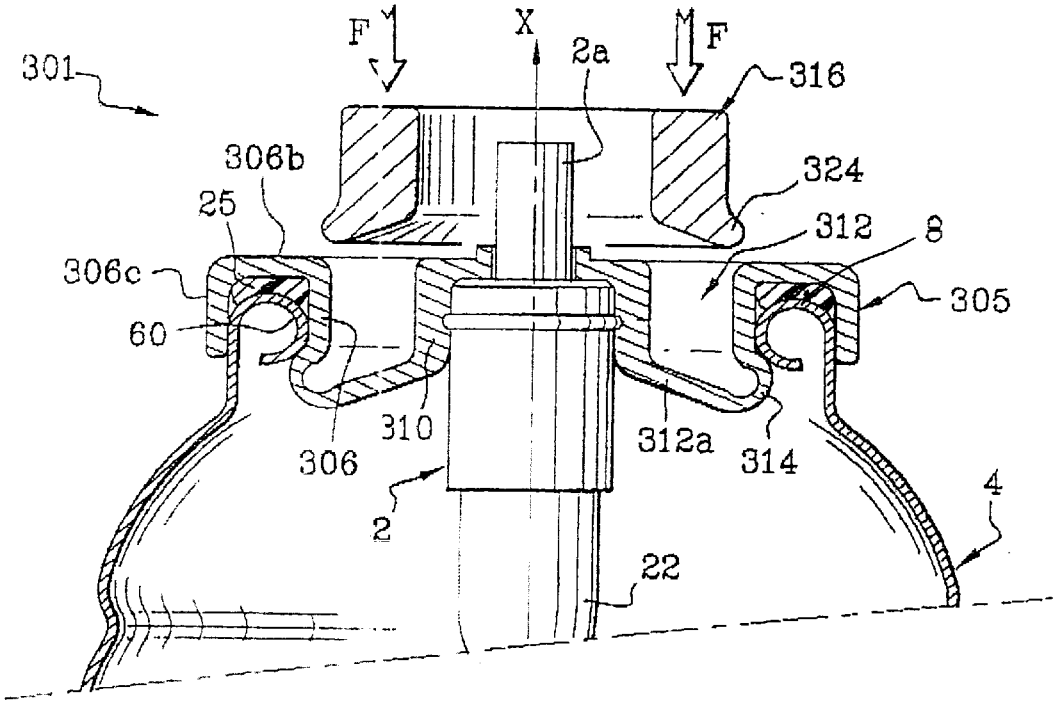

FIG. 4 illustrates a mounting device 301 which can be distinguished from the device 201 through the form of the neck 60, which is rolled in the opposite direction by comparison with the direction in which the neck 50 of FIG. 2 is rolled. An annular region 314 forming a bulge on the outside of the groove 312 allows the cup 305 to be introduced into the opening of the container 4 by deformation. Once the fixing ring 316 has been fitted, the region 314 is locked under the neck 60 by a projecting profile 324 formed on the fixing ring 316. Note that the bottom of the groove 312*a* is inclined for ease of mounting.

Figure 5:
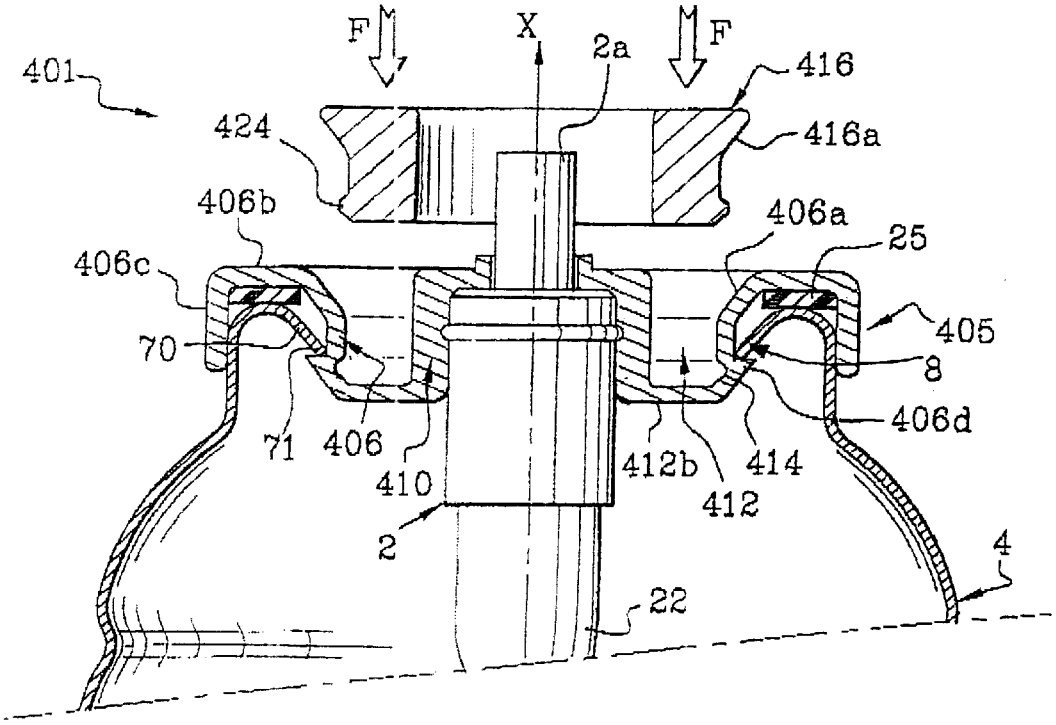

FIG. 5 shows a mounting device 401 which can be mounted on a container neck 70. The neck 70 is formed simply by bending the free edge 71 of the container 4 inwards. To mount the valve holder cup 405 on the neck 70, the first mounting means 406, 406*b*, 406*c* have an annular hook 406*d* projecting inside the U formed by the first mounting means and capable of positioning itself under the free edge 71 of the neck 70. The annular hook 406*d* may be continuous or discontinuous.

A fixing ring 416 is intended to be housed axially in a groove 412 which has a deformable bottom 412*b*. The outer face of this fixing ring has, towards the bottom, a bulge 424. Towards the top, the outer face of the fixing ring has a frustoconical profile 416*a*, the cross section of which decreases progressively towards mid-height of the ring 416. The frustoconical profile 416*a* collaborates with a complementary frustoconical portion 406*a* formed on the cup 405.

Once the fixing ring 416 has been forcibly introduced in the direction of the arrows F, the bulge 424 is housed in a corresponding profile 414 made near an outer portion of the bottom 412*b* of the groove 412. The bottom of the groove 412*b* is thus solidified and the hook 406*d* placed in a non-removable position.

Figure 6:
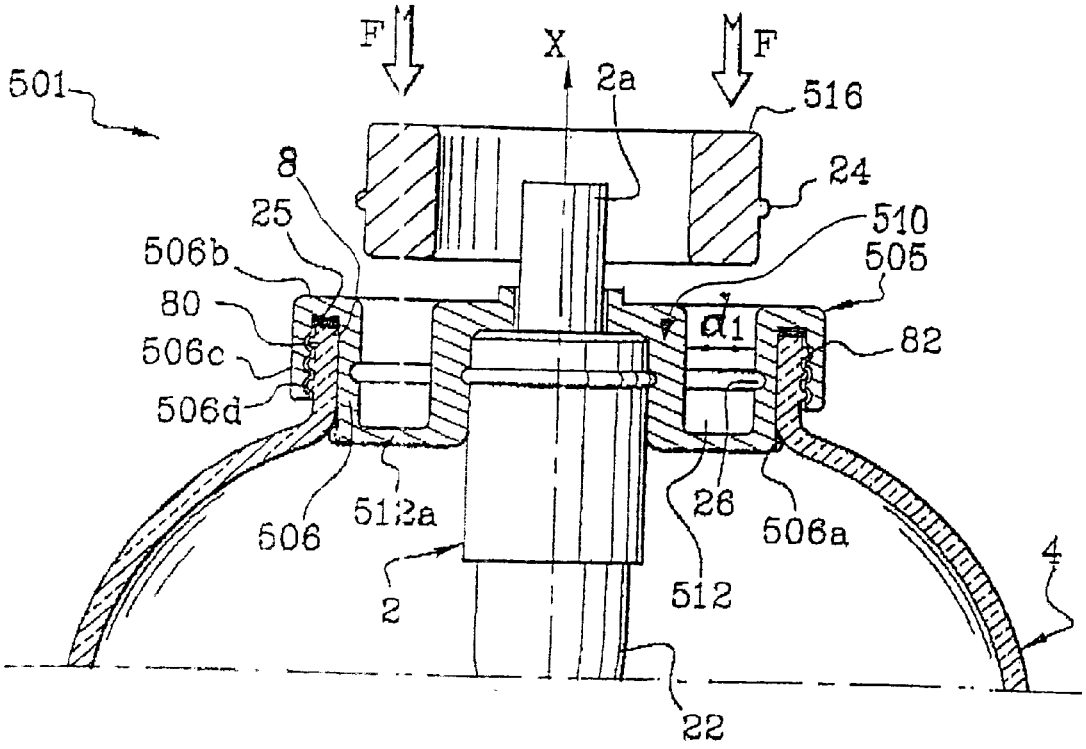

FIG. 6 shows a mounting device 501 suited to the mounting of a valve holder cup 505 on a neck 80 of a container 4 made, in particular, of glass. This neck has an external screw thread 82. The external screw thread 82 is capable of collaborating with a complementary screw thread 506*d* formed on the inside of a peripheral skirt 506*c*, which skirt is secured to the valve holder cup 505. As described previously, the bottom 512*a* of the groove 512 is deformable so that a bulge 506*a* can fit in underneath the neck 80 (see bulge 506*a*). Once the fixing ring 516 has been forcibly introduced, the bottom 512*a* is solidified, simultaneously causing the cup to be fastened non-removably on the container 4, and sealing the mounting assembly.

Figure 7:
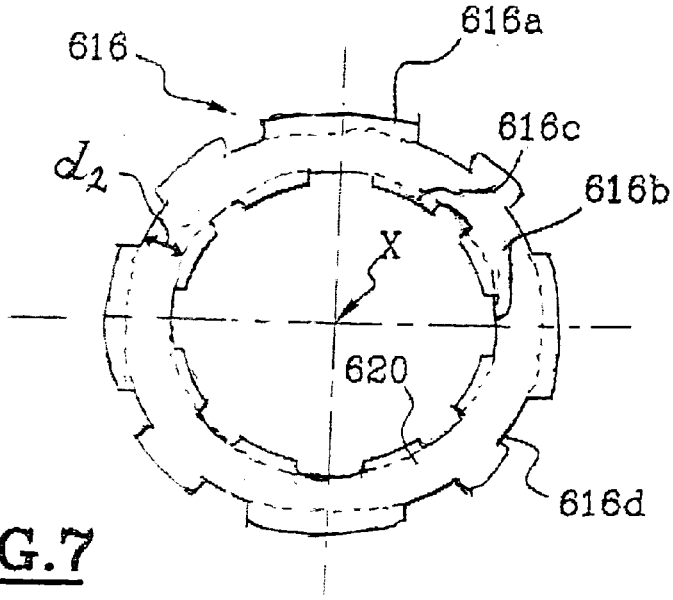
FIG. 7 depicts a view of a locking means that can be used alternatively with the mounting devices illustrated in FIGS. 1 to 6.

FIG. 7 diagrammatically illustrates an alternative form of the fixing ring 616. This fixing ring 616 defines a number of fixing fins 616*a*, 616*c*. This ring has an annular overall structure, the width $d_2$ of which is intended to be housed in one of the grooves 12 . . . 512. For this purpose, the width $d_2$ is slightly less than the width $d_1$ of the groove (512, see FIG. 6). Internal notches 616*b* delimit the fins 616*c*, and face radially towards the axis X. Likewise, external notches 616*d* delimit the fins 616*a* and face outwards.

The ring 616 is made, for example, by stamping a thin bronze plate, so that the fins 616*a*, 616*c* are elastically deformable with respect to the overall plane of the ring 616.

When this ring 616 is introduced into the groove of the valve holder cup, the free end of the fins comes into contact with the first and second mounting means. The fins deform elastically and exert constant lateral pressure on a corresponding part of the first and second mounting means. Thus, they cause at least one portion of the groove to enlarge. Thus, the function of the fixing ring 616 is similar to the function of the rings 16 . . . 516 described previously.

In all the embodiments described hereinabove, the ring 6 . . . 516, by deforming the wall of the groove 12 . . . 512, simultaneously fixes the cup 5 . . . 505 in leaktight manner on the container, and fixes the valve body 2 in leaktight manner in the cup. Thus, using the ring, an internal portion of the groove exerts a clamping effect around the valve body, while an external portion of the cup expands radially under the open edge of the container. This arrangement makes it possible in particular to compensate for the wide variations in tolerance on the various constituent parts and culminate in a leaktight mounting able to withstand high internal pressures.

In the foregoing detailed description, reference was made to some particular embodiments of the invention. It is obvious that variations can be made thereto without departing from the spirit of the invention as claimed hereinafter.

What is claimed is:

1. A mounting device for mounting a dispensing valve on a container of a product under pressure, said mounting device comprising:

first fastening means for fastening said mounting device to an open edge of the container;

a second fastening means for fastening the dispensing valve on said mounting device;

a first groove formed between said first and second fastening means and delimited by at least one deformable wall; and locking means positionable in said first groove, said locking means radially enlarging a bottom of said first groove when said locking means is positioned in said first groove.

2. The mounting device according to claim 1, wherein said bottom of said first groove is not as thick as a remainder of said first groove.

3. The mounting device according to claim 1, wherein said locking means includes an annular element configured for improving a tightness of said first fastening means being clamped to the open edge of the container.

4. The mounting device according to claim 1, wherein said first fastening means forms a second groove opposite said first groove, said second groove being open to grip the open edge of the container.

5. The mounting device according to claim 1, further comprising protrusions for holding said locking means in said first groove.

6. The mounting device according to claim 1, wherein said locking means has chamfers to encourage said locking means to enter said first groove.

7. The mounting device according to claim 1, wherein said locking means is made of any one of plastic and metal.

8. The mounting device according to claim 1, wherein said first fastening part is adapted to be screwed onto the open edge of the container.

9. The mounting device according to claim 1, wherein said locking means comprises an annular element, and at least one portion of said annular element is of a radial thickness to radially enlarge a corresponding portion of at least one of said first and second fastening means when said locking means is positioned in said first groove.

10. The mounting device according to claim 9, wherein said first fastening means is positioned between the open edge of the container and said annular element of said locking means.

11. The mounting device according to claim 1, wherein said first and second fastening means and said first groove are formed as a single piece of plastic.

12. The mounting device according to claim 11, wherein said single piece of plastic is made of polyacetal.

13. The mounting device according to claim 11, wherein said single piece of plastic is made of polyoxymethylene (POM).

14. A dispenser comprising:

a container containing a product pressurized by a propellant;

a dispensing valve mounted on an open edge of said container, wherein said dispensing valve includes an actuator adapted to actuate said dispensing valve to dispense the product; and a mounting device for mounting said dispensing valve on said container, wherein said mounting device includes:

a first fastening means for fastening said mounting device to an open edge of the container;

a second fastening means for fastening the dispensing valve on said mounting device;

a first groove formed between said first and second fastening means and delimited by at least one deformable wall; and locking means positionable in said first groove, said locking means radially enlarging a bottom of said first groove when said locking means is positioned in said first groove.

15. the dispenser according to claim 14, wherein said open edge of said container is shaped as any one of an outwardly rolled neck, an inwardly rolled neck, and a threaded edge.

16. The dispenser according to claim 14, wherein said dispensing valve includes a body made of an elastomeric material.

17. A mounting device configured to mount a dispensing valve on a container of a product under pressure, said mounting device comprising:

a first fastener configured to fasten said mounting device to an open edge of the container;

a second fastener configured to fasten the dispensing valve on said mounting device;

a first groove formed between said first and second fasteners and delimited by at least one deformable wall; and a locking part positionable in said first groove, said locking part and said first fastener being adapted and configured such that a bottom of said first groove is radially enlarged when said locking part is positioned in said first groove.

18. The mounting device according to claim 17, wherein said locking part comprises an annular element, and at least one portion of said annular element is of a radial thickness to radially enlarge a corresponding portion of at least one of said first and second fastening parts when said locking part is positioned in said first groove.

19. The mounting device according to claim 17, further comprising protrusions for holding said locking part in said first groove.

20. The mounting device according to claim 17, wherein said locking part has chamfers to encourage said locking part to enter said first groove.

21. A dispenser comprising:

a container containing a product pressurized via a propellant device;

a dispensing valve mounted on an open edge of said container, wherein said dispensing valve includes an actuating device configured to actuate said dispensing valve to dispense the product; and a mounting device configured to mount said dispensing valve on said container, wherein said mounting device includes:

a first fastening device configured to fasten said mounting device to an open edge of said container;

a second fastening device configured to fasten said dispensing valve on said mounting device;

a first groove formed between said first and second fastening devices and delimited by at least one deformable wall; and a locking part positionable in said first groove, said locking part and said first fastening device being adapted and configured such that a bottom of said first groove is radially enlarged when said locking part is positioned in said first groove.

* * * * *